United States Patent [19]

Friesen

[11] Patent Number: 4,801,142

[45] Date of Patent: Jan. 31, 1989

[54] ADJUSTABLE BASETBALL GOAL

[76] Inventor: Vernon W. Friesen, 411 S. Wilson, Hillsboro, Kans. 67063

[21] Appl. No.: 34,856

[22] Filed: Apr. 3, 1987

Related U.S. Application Data

[63] Continuation-in-part of Ser. No. 894,003, Aug. 7, 1986, abandoned.

[51] Int. Cl.[4] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 278,797 | 6/1983 | Ide . | |
| 344,652 | 6/1983 | Hammerstein . | |
| 2,881,003 | 4/1959 | Drew | 273/1.5 R |
| 3,427,025 | 2/1969 | Procter | 273/1.5 R |
| 3,602,505 | 8/1971 | Friend | 273/1.5 R |
| 3,669,450 | 6/1972 | Mason | 273/1.5 R |
| 3,722,886 | 3/1973 | Sinner | 273/1.5 R |
| 4,330,101 | 5/1982 | Andersen | 248/284 |
| 4,395,040 | 7/1983 | White | 273/1.5 R |
| 4,407,498 | 10/1983 | Clore et al. | 273/1.5 R |
| 4,465,277 | 8/1984 | Dittrich | 273/1.5 R |

FOREIGN PATENT DOCUMENTS

| | | | |
|---|---|---|---|
| 681631 | 5/1966 | Belgium | 273/1.5 R |
| 6413102 | 5/1966 | Netherlands | 273/1.5 R |

*Primary Examiner*—Paul E. Shapiro

*Attorney, Agent, or Firm*—Bill D. McCarthy

[57] ABSTRACT

An adjustable basketball goal with a lift cable and winch for raising and lowering the basketball goal. The cable provides for raising and lowering the goal for use by basketball players of various heights, and includes a height indicator assembly thereon for indicating the height of the basketball hoop above the playing surface. Also, a safety cylinder prevents rapid descent of the backboard portion to prevent injuries.

4 Claims, 3 Drawing Sheets

ADJUSTABLE BASETBALL GOAL

CROSS REFERENCE TO RELATED APPLICATION

This application is a continuation-in-part application of Ser. No. 894,003, entitled ADJUSTABLE BASKETBALL GOAL WITH A LIFT CABLE, filed on Aug. 7, 1986 by the present inventor, and now abandoned.

BACKGROUND OF THE INVENTION

1. Field of the Invention.

The present invention relates generally to an adjustable basketball goal with a parallelogram structure and more particularly, but not by way of limitation, to an adjustable goal having a lift cable for raising and lowering the goal and safety means for gradually lowering the hoop and backboard should the cable break.

2. Brief Description of the Prior Art.

Heretofore, there have been various types of basketball goals using a parallelogram arrangement for adjusting the height of a basketball goal. They are described in U.S. Pat. No. 4,395,040 to White, U.S. Pat. No. 4,465,277 to Dittrich, U.S. Pat. No. 4,330,101 to Anderson, U.S. Pat. No. 344,652 to Hammerstein, U.S. Pat. No. 278,797 to Ide, U.S. Pat. No. 3,669,450 to Mason, U.S. Pat. No. 3,722,886 to Sinner, U.S. Pat. No. 3,602,505 to Friend.

Also basketball goals can be raised and lowered using winch, cable and pulley systems such as taught in U.S. Pat. No. 3,427,025 to Procter, U.S. Pat. No. 2,881,003 to Drew, Netherlands patent No. 6,413,102 to Nijha and Belgium patent No. 681,631 to De Clerck. Further, in U.S. Pat. No. 4,407,498 issued to Clore et al. an independent lock for a safety belt is described. The belt holds a raised basketball goal in place should the cable used in raising the goal break.

None of these prior art patents describe the particularly unique features and advantages of the subject basketball goal.

SUMMARY OF THE INVENTION

The basketball goal of the present invention uses a parallelogram structure for maintaining the goal's backboard in a vertical position when raising and lowering the goal to desired elevations. It can be installed in backyards, driveways, playgrounds and other locations.

The adjustable basketball goal comprises a horizontal basketball hoop attached to the front of a vertically extending backboard. The backboard includes a backboard support frame. One end of the upper and lower parallel support arms are attached to the frame. The other end of the support arms are pivotally attached to the top of a hollow vertical stand. The upper support arms extend rearwardly from the top of the stand and are attached to one end of a hydraulic safety cylinder with the other end of the safety cylinder attached to the back of the vertical stand. A cable, attached at one end to the vertical backboard and received over a pulley attached to the top of the vertical stand, extends through the hollow stand and is attached to a cable winch mounted in the vertical stand. Retraction or extension of the cable from the cable winch selectively raises or lowers the goal to a standard height or to a reduced height to accommodate shorter basketball players.

Further, the present basketball goal includes a height indicator assembly mounted on the hollow stand and attached to one of the support arms for indicating the height of the hoop above the playing surface. The hydraulic safety cylinder prevents the backboard support frame from falling rapidly should the supporting cable fail or the winch rotate too fast.

The advantages and objects of the invention will become evident from the following detailed description of the drawings when read in connection with the accompanying drawings which illustrate preferred embodiments of the invention.

BRIEF DESCRIPTION OF THE DRAWINGS

FIG. 6 is a front view of a height indicator tape with measuring scale used in the assembly.

DESCRIPTION

Figure 1:
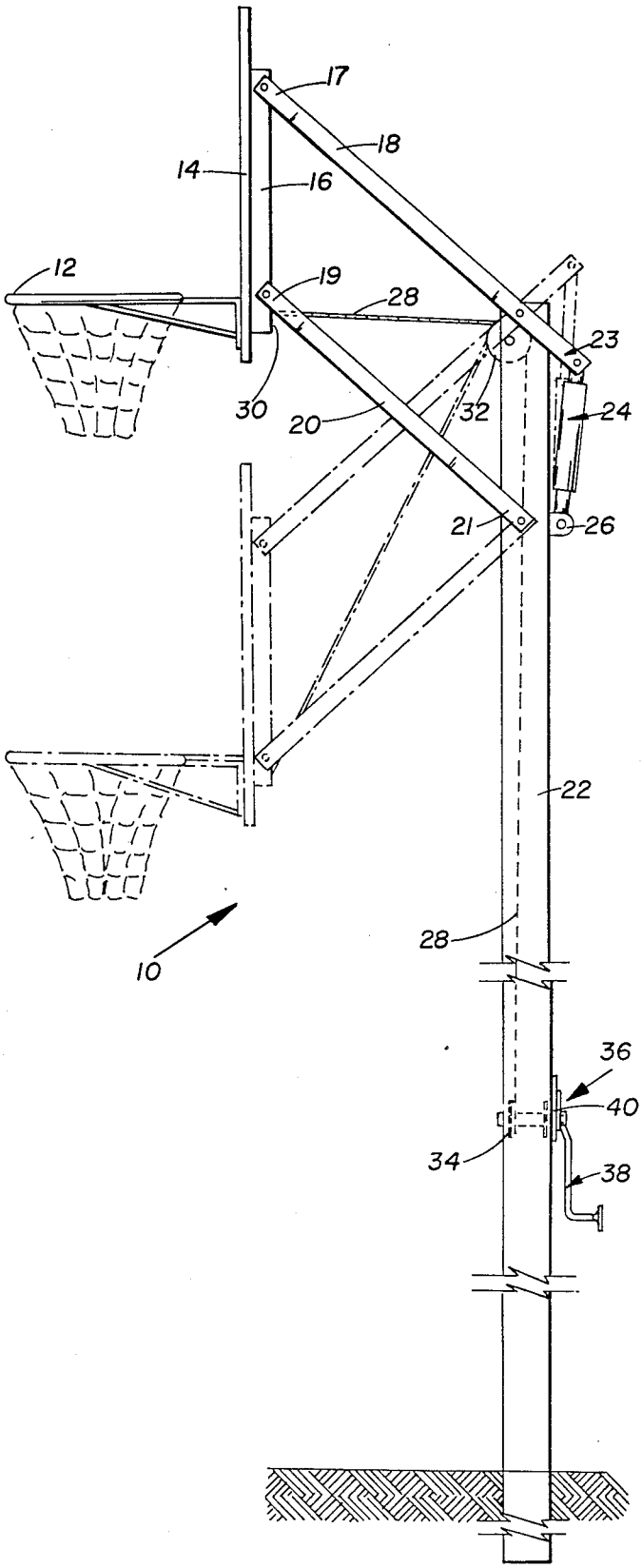
FIG. 1 illustrates a side view of the adjustable basketball goal with cable lift raised in a standard position and shown in dotted lines in a lowered position.

In FIG. 1 the adjustable basketball goal is designated by general reference numeral 10. The goal 10 includes a horizontal basketball hoop 12 attached to the lower front of a vertical backboard 14. Mounted on back of the backboard 14 is an angular shaped support frame 16. Pivotally attached to the backboard support frame 16 are first ends 17 of a pair of upper parallel support arms 18 and first ends 19 of lower parallel support arms 20. The lower support arms 20 include second ends 21 pivotally attached to a hollow vertical stand 22. The upper support arms 18 are also pivotally attached to the top of the stand 22 with second ends 23 extending rearwardly from the stand 22 and attached to one end of a hydraulic safety cylinder 24. The other end of the safety cylinder 24 is attached to a bracket 26 secured to the rear of the stand 22. The safety cylinder 24 is of the type of such devices that offer unilateral resistance to extension of the rod of the safety cylinder only; that is, resistance is provided to extension of the rod of the safety cylinder but not to the retraction of same. Thus, in the position of the backboard 14 shown in solid lines in FIG. 1, the safety cylinder 24 has no effect thereon; but should the backboard 14 move to the position depicted by dotted lines in FIG. 1, the extension of the rod of the safety cylinder is resisted to retard the rate at which the backboard 14 can lower. The safety cylinder 24 is of conventional construction and is available, by way of example, from Gabriel of Canada, Ltd. as cylinder number 635700.

The basketball goal 10 as mentioned above is adjustable in height using a cable 28 having one end 30 attached to the frame 16 with the cable received over a pulley 32 mounted inside the top of the stand 22. The cable is threaded inside the stand 22 which is hollow and extends downwardly as shown in dotted lines and received around a reel or spool 34 which is part of a cable winch having a general reference numeral 36. The winch 36 further includes a winch handle 38 with sprocket 40 which is used for engaging a latch 42 shown in FIG. 3. The handle 38 is positioned behind the rear of the stand 22 to protect players from possibly hitting the handle during a game.

Figure 2:
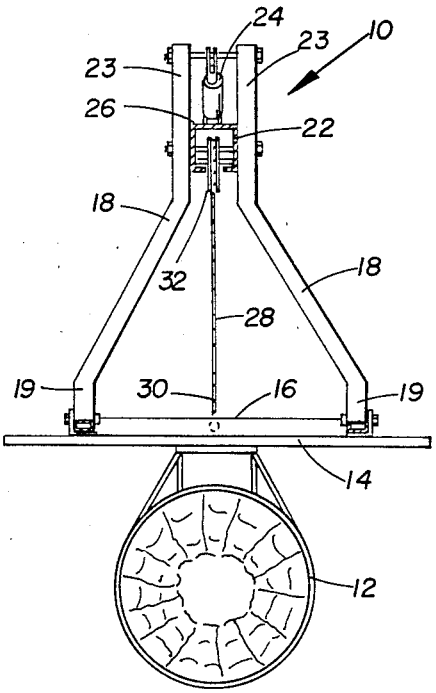
FIG. 2 illustrates a top view of the basketball goal with lift cable.

FIG. 2 illustrates that by unwinding the cable 28 on the winch 36 the weight of the backboard 14 and hoop 12 causes the goal 10 to be lowered to a position depicted by the dotted lines. Further, it will be noted that through the use of the cable 28 the goal 10 can be adjusted to various heights depending on the desire of the basketball player.

For safety purposes, to prevent the backboard 14 and hoop 12 from crashing downwardly in the event that the cable should break, for example, with the possibility of injuring a player and damaging the goal 10, the safety cylinder 24 is provided to effect a gradual descent of the goal 10.

In FIG. 2 a top view of the goal 10 is shown with the upper parallel support arms 18 pivotally attached to the frame 16. The lower parallel arms 20 are similar to the upper parallel support arms 18 and are hidden behind the upper parallel support arms 18. In this Figure the pulley 32 is shown receiving a portion of the cable 28 as it extends thereover and downwardly inside the hollow of the stand 22.

Figure 3:
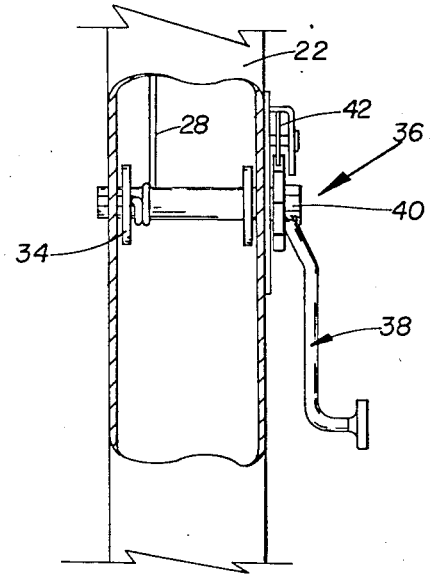
FIG. 3 illustrates a partial sectional view of the vertical stand and cable winch for winding cable thereon.

In FIG. 3 an enlarged cutaway view of the winch 36 is shown with the sprocket 40 engaging the latch 42. As the cable 28 is wound around the spool 34 the latch 42 engages the sprocket to prevent the unwinding of the cable on the reel 34. While various types of winches can be used in this application, the winch 36 permits loosening of the handle 38 on the spool 34 while the weight of the goal 10 holds the tension in the cable 28 until the handle 38 is actually turned clockwise for raising the goal or counter clockwise for lowering the goal. Since the weight of the goal is supported by the cable, the selected extension or retraction of the cable via the winch 36 permits the disposition of the goal at any desired elevation as it is raised and lowered.

Figure 4:
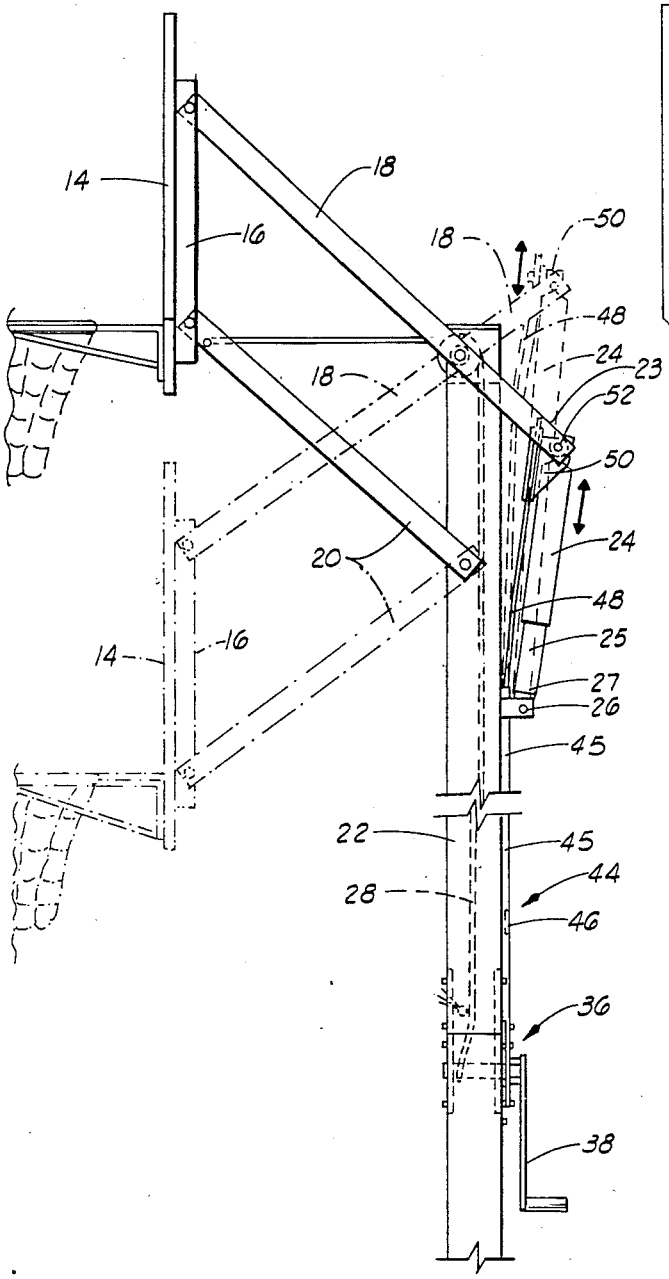
FIG. 4 illustrates a side view of the vertical stand with a height indicator assembly mounted thereon.

In FIG. 4 the vertical stand 22 is shown with the winch 36 having raised the hoop 12 with the support arms 18 and 20 in a raised position. The safety cylinder 24 includes an extending portion 25 with its lower end 27 attached to the bracket 26. As the hoop 12 and backboard 14 are lowered, the safety cylinder 24 extends as depicted but at a rate of extension that retards such lowering very rapidly. The safety cylinder 24 and arms 18 and 20 are also shown in dotted lines in this Figure and at a position when the hoop 12 and backboard 14 have been lowered. A complete side view of the goal 10 in a lowered position is shown in dotted lines in FIG. 1.

The goal 10 further includes a height indicator assembly having a general reference numeral 44. The assembly 44 has an elongated tape housing 45 with an eye sight bore 46 in the housing 45. The housing 45 receives an elongated height indicator tape 48. The top of the tape 48 extends upwardly from the housing 45 as shown in FIG. 4 and is secured to the top of the safety cylinder 24 using a "U" shaped hydraulic cylinder mounting bracket 50. A pin 52 is used to secure the bracket 50, safety cylinder 24 and the second ends 23 of arms 18. As the safety cylinder 24 is extended, as shown in dotted lines, the bracket 50 pivots on the pin 52 and moves upwardly with the safety cylinder 24, thus sliding the tape 48 inside the housing 45 upwardly. The movement of the tape 48, by raising or lowering the backboard 14 the safety cylinder 24, provides a means for indicating the change in height of the hoop 12 above a playing surface shown FIG. 1.

Figure 5:
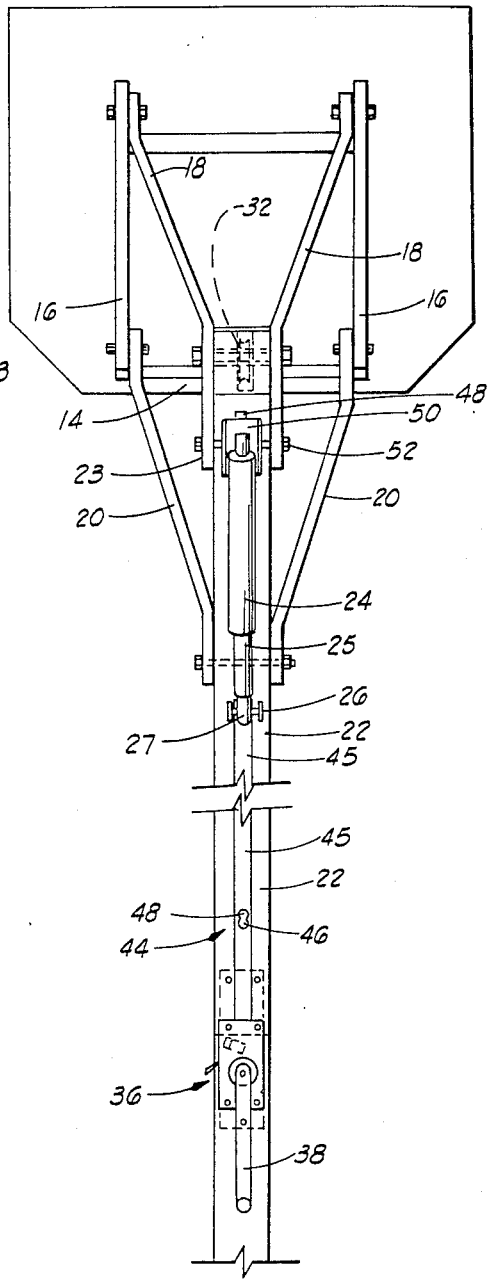
FIG. 5 shows a rear view of the vertical stand with height indicator assembly.

FIG. 5 shows a rear view of the stand 22 with the assembly 42 disposed along its length. In this view the eye sight bore 46 and tape 48 is shown with the bore 46 positioned in the housing 45 above the winch 36. As the winch 36 is used by an operator to either lower or raise the hoop 12 and backboard 14, the eye sight bore 46 provides the operator continuous indication of the height of the hoop 12.

In FIG. 6 the tape 48 is shown with a measuring scale 54 secured to the face of the tape 48. The scale, in this example, has measurements in inches and feet from less than six feet to above ten feet and is calibrated to the correct height of the hoop 12. The standard height of a basketball hoop 12 is ten feet above the playing surface, and the hoop 12 using scale 54 can be lowered to under six feet for small players or to any height therebetween.

Figure 7:
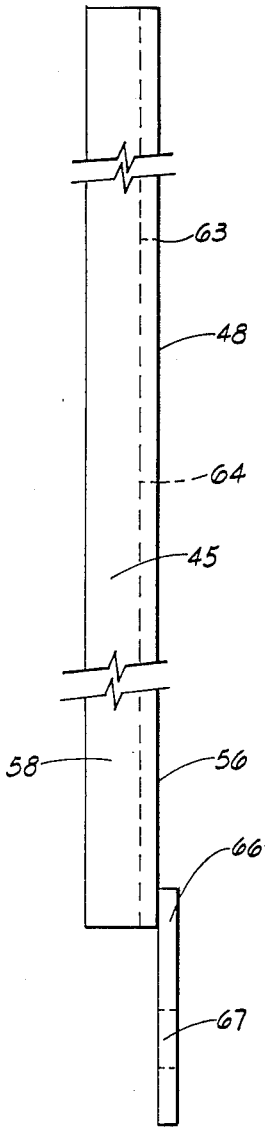
FIG. 7 and FIG. 8 are side and front views of a tape housing with eye sight used in the assembly.
Figure 8:
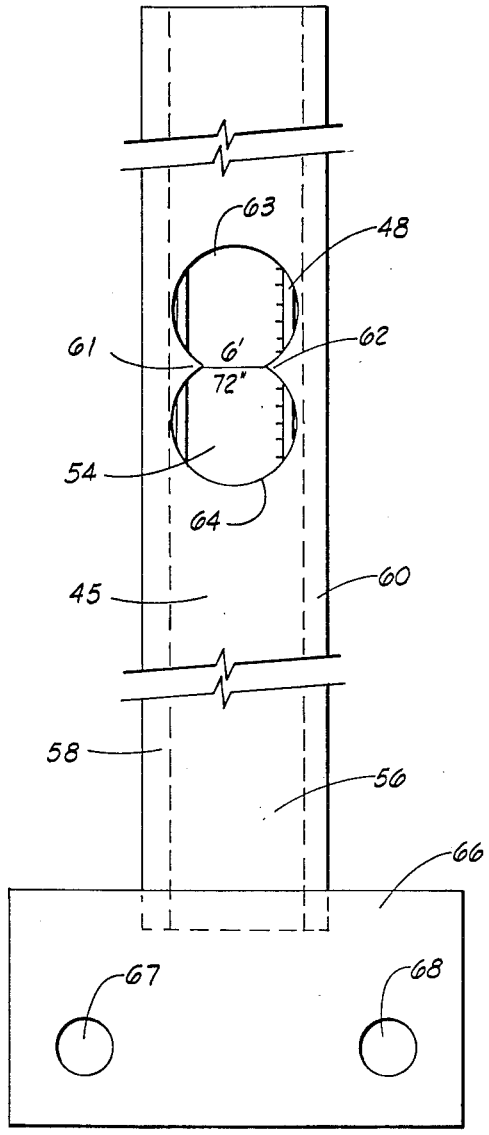
Figure 9:
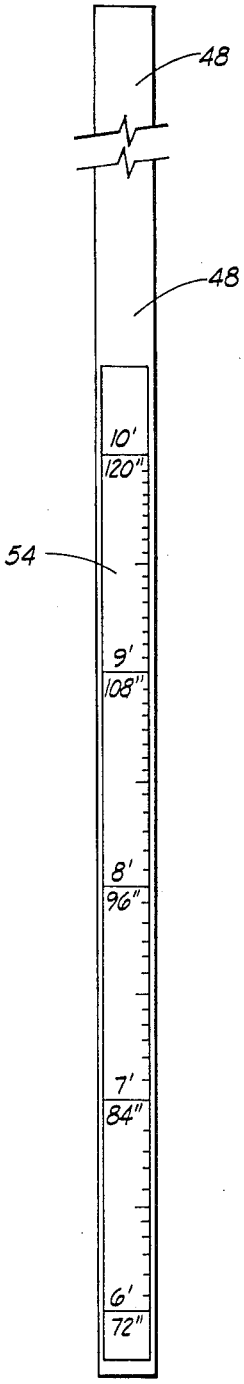

FIGS. 7 and 8 illustrate side and front views of the tape housing 45 having a face plate 56 and right angle side plates 58 and 60 which go together to form a "U" shaped channel for receiving the tape 48 therein. The lower end of the tape 48 is not attached so that it slides freely in the channel of the housing 45. In FIG. 8 the height of six feet or seventy-two inches is indicated by identical pointers 61 and 62 formed by two circular bores 63 and 64. Secured to the bottom of the housing 45 is a mounting plate 66 having two apertures 67 and 68. The plate 66 secured to the housing 45 and the stand 22 adjacent the winch 36 via appropriate screws or bolts.

From reviewing the above description of the drawings, it will be apparent that the unique characteristic of the basketball goal of the present invention is that it can be easily and quickly adjusted for smaller children or players of different heights. The basketball goal 10 is readily adaptable for different types of installations such as backyards, playgrounds, school yards and the like and can be used by young and old alike. The goal is designed with safety in mind, and with the added feature of the height indicator assembly the operator of the winch can determine exactly how high the hoop is above the playing surface.

Further, it is clear that the present invention is well adapted to carry out the objects and to attain the ends and advantages mentioned herein as well as those inherent in the invention. While presently preferred embodiments of the invention have been described for purposes of this disclosure, numerous changes may be made which will readily suggest themselves to those skilled in the art and which are accomplished within the spirit of the invention disclosed and as defined in the appended claims.

What is claimed is:

1. An adjustable basketball goal comprising:

a vertical backboard having a basketball hoop attached thereto;

a pair of upper and lower parallel support arms pivotally attached to the back of the backboard at a first end thereof;

a vertical hollow stand, the support arms pivotally attached to the top of the stand near the second ends thereof, the second ends of the upper parallel support arms extending rearwardly from the top of the stand;

a cable having a first end attached to the back of the backboard, the cable received over a pulley rotatably mounted inside the top of the hollow stand;

winch means mounted in the stand for receiving a second end of the cable around a spool portion thereof so that by winding or unwinding a winch handle connected to the spool, the goal can be raised and lowered by the cable;

a hydraulic safety cylinder pivotally attached to the second ends of the upper parallel support arms, the cylinder having a piston extending outwardly therefrom and pivotally attached to a mounting attached to the rear of the vertical stand, the cylinder and piston allowing gradual descent of the basketball hoop and vertical backboard should the cable break; and a height indicator assembly comprising:

an elongated tape housing secured to the vertical stand, the housing having an eye sigh bore therein; and a height indicator tape with measuring scale thereon, the tape slideably received between the stand and the housing, the top of the tape extending upwardly from the top of the housing and secured to one of the support arms, a portion of the scale seen through the eye sight bore for indicating the height of the hoop above the playing surface.

2. An adjustable basketball goal comprising:

a vertically extending backboard having a basketball hoop attached thereto;

a pair of upper and lower parallel support arms having a first end pivotally attached to the back of the backboard;

a vertical hollow stand, the support arms having a second end pivotally attached to the top of the stand;

a cable having a first end attached to the back of the backboard, the cable received over a pulley rotatably mounted inside the top of the hollow stand;

winch means mounted in the stand for receiving a second end of the cable around a spool portion thereof, the winch means having a winch handle for rotating the spool to extend or retract the cable so that the basketball hoop can be raised and lowered; and a height indicator assembly mounted on the hollow stand and attached to one of the support arms for indicating the height of the hoop above a playing surface, the height indicator assembly comprising:

an elongated tape housing secured to the vertical stand, the housing having an eye sight bore therein; and a height indicator tape with measuring scale thereon, the tape slideably received between the stand and the housing, the top of the tape extending upwardly from the housing and secured to one of the support arms, a portion of the scale seen through the eye sight bore for indicating the height of the hoop above the playing surface.

3. The basketball goal of claim 2 further comprising safety means attached to the upper support arm and to the stand for preventing the backboard from rapidly falling should the cable break.

4. The basketball goal of claim 2 further comprising a hydraulic safety cylinder pivotally attached to the rear of the stand, the safety cylinder having an extension rod pivotally attached to the upper support arm the extension rod moveable between an extended position and a retracted position, the extension rod having resistance imparted thereto when in the extended position for preventing the backboard from rapidly falling upon breakage of the cable.

* * * * *

UNITED STATES PATENT AND TRADEMARK OFFICE

CERTIFICATE OF CORRECTION

PATENT NO. : 4,801,142

DATED : January 31, 1989

INVENTOR(S) : Vernon W. Friesen

It is certified that error appears in the above-identified patent and that said Letters Patent is hereby corrected as shown below:

Cover sheet - [54] Title, reads "ADJUSTABLE BASETBALL GOAL" should read --ADJUSTABLE BASKETBALL GOAL. In column 5, line 17, the words "sigh bore" should read --sight bore--.

Signed and Sealed this

Twenty-third Day of April, 1991

*Attest:*

HARRY F. MANBECK, JR.

*Attesting Officer*

*Commissioner of Patents and Trademarks*